US011644169B1

(12) United States Patent
Lee

(10) Patent No.: US 11,644,169 B1
(45) Date of Patent: May 9, 2023

(54) LAMP FOR VEHICLE AND VEHICLE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/814,769

(22) Filed: Jul. 25, 2022

(30) Foreign Application Priority Data

Dec. 14, 2021 (KR) ..... 10-2021-0178503

(51) Int. Cl.

| | |
|---|---|
| ***F21S 41/255*** | (2018.01) |
| ***F21S 41/143*** | (2018.01) |
| ***F21S 41/19*** | (2018.01) |
| ***F21Y 115/10*** | (2016.01) |

(52) U.S. Cl.
CPC ..... *F21S 41/255* (2018.01); *F21S 41/143* (2018.01); *F21S 41/192* (2018.01); *F21Y 2115/10* (2016.08)

(58) Field of Classification Search
CPC ..... F21S 41/143; F21S 41/192; F21S 41/255; F21Y 2115/10
See application file for complete search history.

(56) References Cited

U.S. PATENT DOCUMENTS

2009/0185382 A1* 7/2009 Chiang ..... F21S 41/43 362/310

* cited by examiner

*Primary Examiner* — Jason M Han
(74) *Attorney, Agent, or Firm* — DLA Piper LLP (US)

(57) ABSTRACT

A lamp for a vehicle, the lamp including a plurality of optical modules, in which the plurality of optical modules each includes a light source configured to emit light, an inner lens disposed forward of the light source, a lens holder disposed at one side of the inner lens and provided to be in close contact with the inner lens, and a bezel disposed at the other side of the inner lens and provided to be in close contact with the inner lens, in which a through-hole is provided in at least one lateral surface of the lens holder so that the light emitted from the light source passes through the through-hole.

20 Claims, 9 Drawing Sheets

LAMP FOR VEHICLE AND VEHICLE INCLUDING THE SAME

CROSS-REFERENCE TO RELATED APPLICATION

This application claims priority to and the benefit of Korean Patent Application No. 10-2021-0178503 filed in the Korean Intellectual Property Office on Dec. 14, 2021, the entire contents of which are incorporated herein by reference.

TECHNICAL FIELD

The present disclosure relates to a lamp for a vehicle and a vehicle including the same.

BACKGROUND ART

Recently, the development of a lamp having a slim structure has been consistently conducted as a slim beam pattern has been required to be formed by a lamp mounted in a vehicle. In particular, recently, studies have been conducted on a lamp having a structure with a reduced height in an upward/downward direction by reflecting the customer's tendency to prefer a small beam pattern with a small width in the upward/downward direction.

As one of the methods of forming a beam pattern having a small width in the upward/downward direction and extending in a leftward/rightward direction, a plurality of small-sized optical modules is disposed in the leftward/rightward direction. That is, in the related art, the plurality of optical modules each forms a unit beam pattern having a smallest size, and the plurality of unit beam patterns are collected to implement a beam pattern having a small width in the upward/downward direction and extending in the leftward/rightward direction.

However, in the related art, the unit beam patterns respectively formed by the plurality of optical modules are disconnected, which makes it impossible to implement the beam pattern continuously extending in the leftward/rightward direction. For this reason, there is a problem in that the shape of the beam pattern cannot meet the customer's needs.

SUMMARY

The present disclosure has been made in an effort to provide a lamp for a vehicle, which is capable of forming a beam pattern having a continuous shape by removing interruption between beam patterns respectively formed by a plurality of optical modules provided in the lamp for a vehicle.

An exemplary embodiment of the present disclosure provides a lamp for a vehicle, the lamp including: a plurality of optical modules, in which the plurality of optical modules each includes: a light source configured to emit light; an inner lens disposed forward of the light source; a lens holder disposed at one side of the inner lens and provided to be in close contact with the inner lens; and a bezel disposed at the other side of the inner lens and provided to be in close contact with the inner lens, in which a through-hole is provided in at least one lateral surface of the lens holder so that the light emitted from the light source passes through the through-hole.

The bezel may include a light transmissive material.

The plurality of optical modules may be disposed in a leftward/rightward direction W, the lens holder may include:

a first holder region disposed rearward of the inner lens and configured to press at least a part of a rear surface of the inner lens; and a second holder region extending rearward from one end of the first holder region based on the leftward/rightward direction W, and the through-hole may include a lateral through-hole provided in the second holder region.

The bezel may include: a first bezel region disposed forward of the inner lens and configured to press at least a part of a front surface of the inner lens; and a second bezel region extending rearward from one end of the first bezel region based on the leftward/rightward direction W, and the second bezel region may face the second holder region in the leftward/rightward direction W.

The lens holder may further include a third holder region extending rearward from one end of the first holder region based on an upward/downward direction H, and the third holder region may be made of a non-transmissive material.

The first bezel region may be disposed to face a peripheral region of the front surface of the inner lens, and a central region of the first bezel region may be opened in a forward/rearward direction.

The plurality of optical modules may include: a first optical module; and a second optical module disposed adjacent to one side of the first optical module in the leftward/rightward direction W, and the first bezel region of the first optical module and the second bezel region of the second optical module may be integrated.

The lens holder may further include a fourth holder region extending forward from one end of the first holder region based on the leftward/rightward direction W and configured to surround the inner lens from the outside in the leftward/rightward direction W.

The fourth holder region may be provided to be in close contact with a rear surface of the first bezel region.

The lens holder may further include a fifth holder region extending forward from one end of the first holder region based on the upward/downward direction H and configured to surround the inner lens from the outside in the upward/downward direction H.

The fifth holder region may be provided to be in close contact with a rear surface of the first bezel region.

The lateral through-hole may be provided in plural, and the plurality of lateral through-holes may be provided in the second holder region and spaced apart from one another in an upward/downward direction H.

The lamp may further include an optic member having light transmissivity and provided to be in close contact with a front surface of the first bezel region, and the optic member may have a shape having a length in a forward/rearward direction that increases in a downward direction.

The optic member may have a triangular prismatic shape.

The optic member may be provided in plural, and the plurality of optic members may be disposed along a peripheral region of the first bezel region.

The inner lens may be a micro-lens array (MLA).

The lamp may further include: a collimator disposed between the light source and the inner lens; and a heat sink provided to be in close contact with a rear portion of the light source.

The plurality of optical modules may be spaced apart from one another in a leftward/rightward direction W, and the lamp may further include: an additional light source disposed between the two optical modules adjacent to each other in the leftward/rightward direction W; and an additional bezel disposed forward of the additional light source and having two opposite ends disposed in the leftward/ rightward direction W and provided to be in close contact with the bezels respectively provided in the two optical modules.

The bezel and the additional bezel may have different geometric shapes.

Another exemplary embodiment of the present disclosure provides a vehicle including: a lamp for a vehicle, including a plurality of optical modules, in which the plurality of optical modules each includes: a light source configured to emit light; an inner lens disposed forward of the light source; a lens holder disposed at one side of the inner lens and provided to be in close contact with the inner lens; and a bezel disposed at the other side of the inner lens and provided to be in close contact with the inner lens, in which a through-hole is provided in at least one lateral surface of the lens holder so that the light emitted from the light source passes through the through-hole.

According to the present disclosure, it is possible to provide the lamp for a vehicle, which is capable of forming a beam pattern having a continuous shape by removing interruption between beam patterns respectively formed by the plurality of optical modules provided in the lamp for a vehicle.

DETAILED DESCRIPTION

Hereinafter, a lamp for a vehicle and a vehicle according to the present disclosure will be described with reference to the drawings.

Lamp for Vehicle

Figure 1:
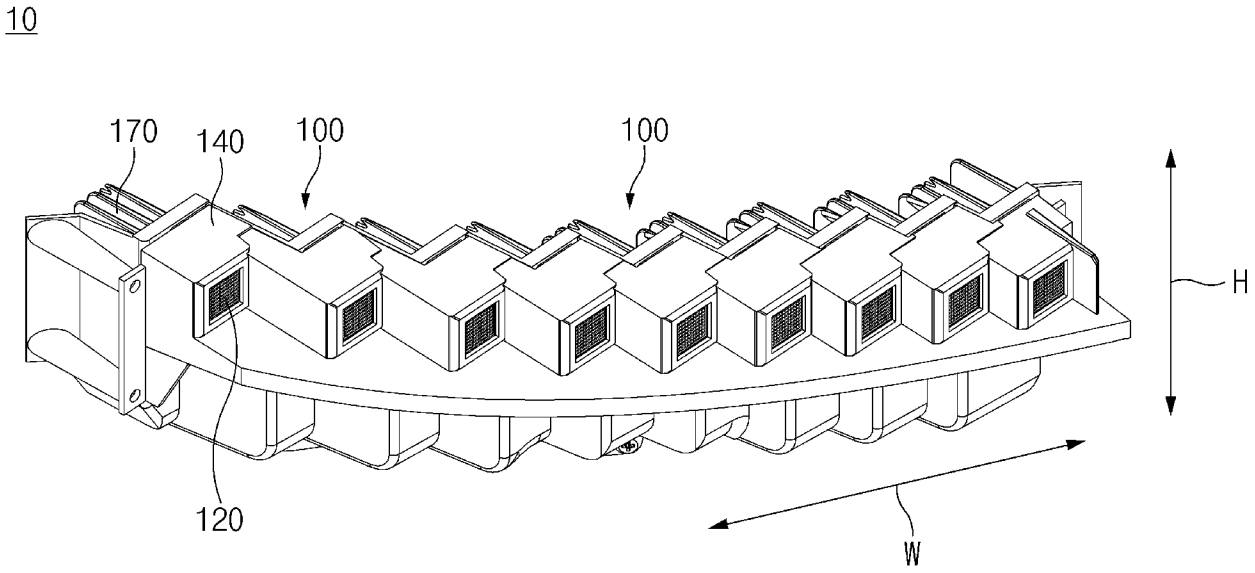
FIG. 1 is a view perspective view illustrating a structure of a lamp for a vehicle according to an embodiment of the present disclosure.
Figure 2:
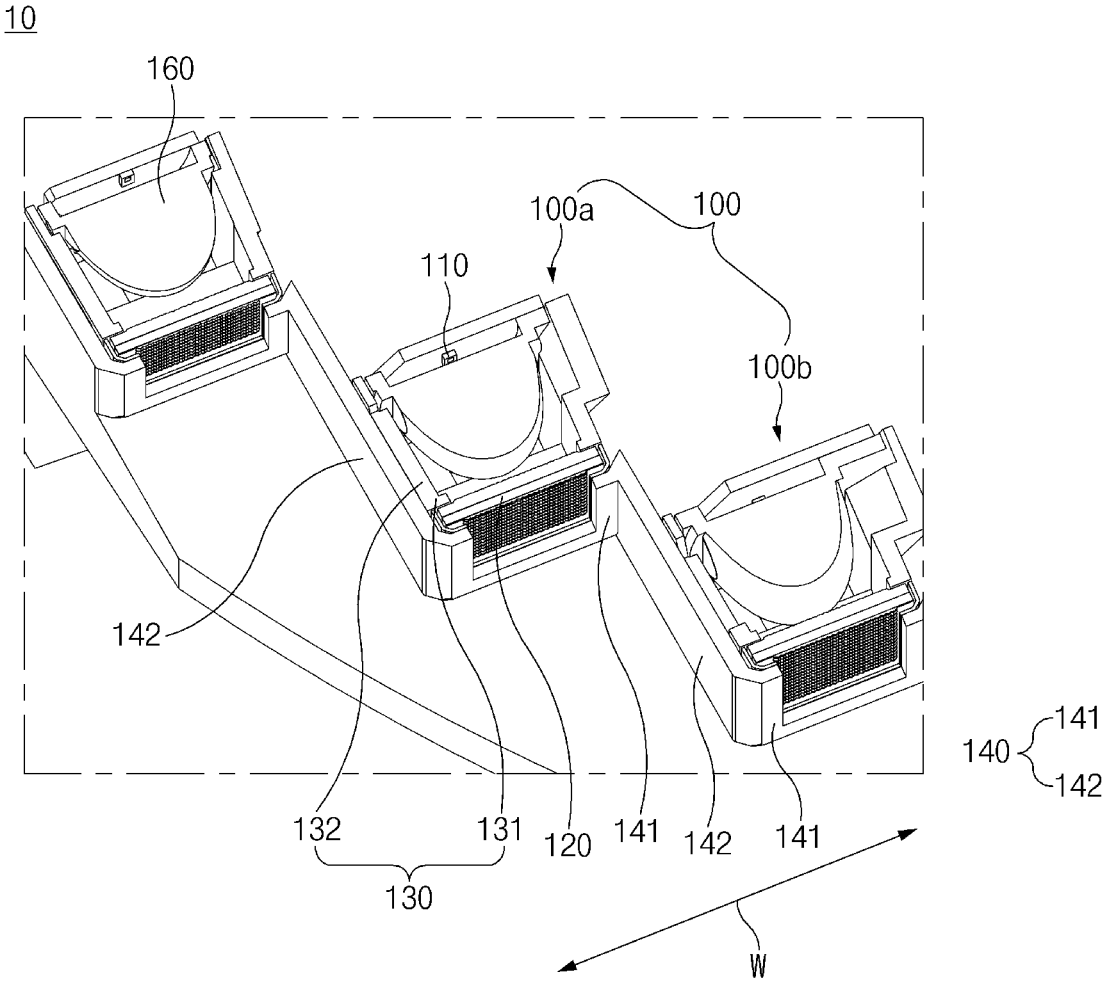
FIG. 2 is a cross-sectional perspective view illustrating a structure when the lamp for a vehicle according to the embodiment of the present disclosure is cut in a horizontal direction.
Figure 3:
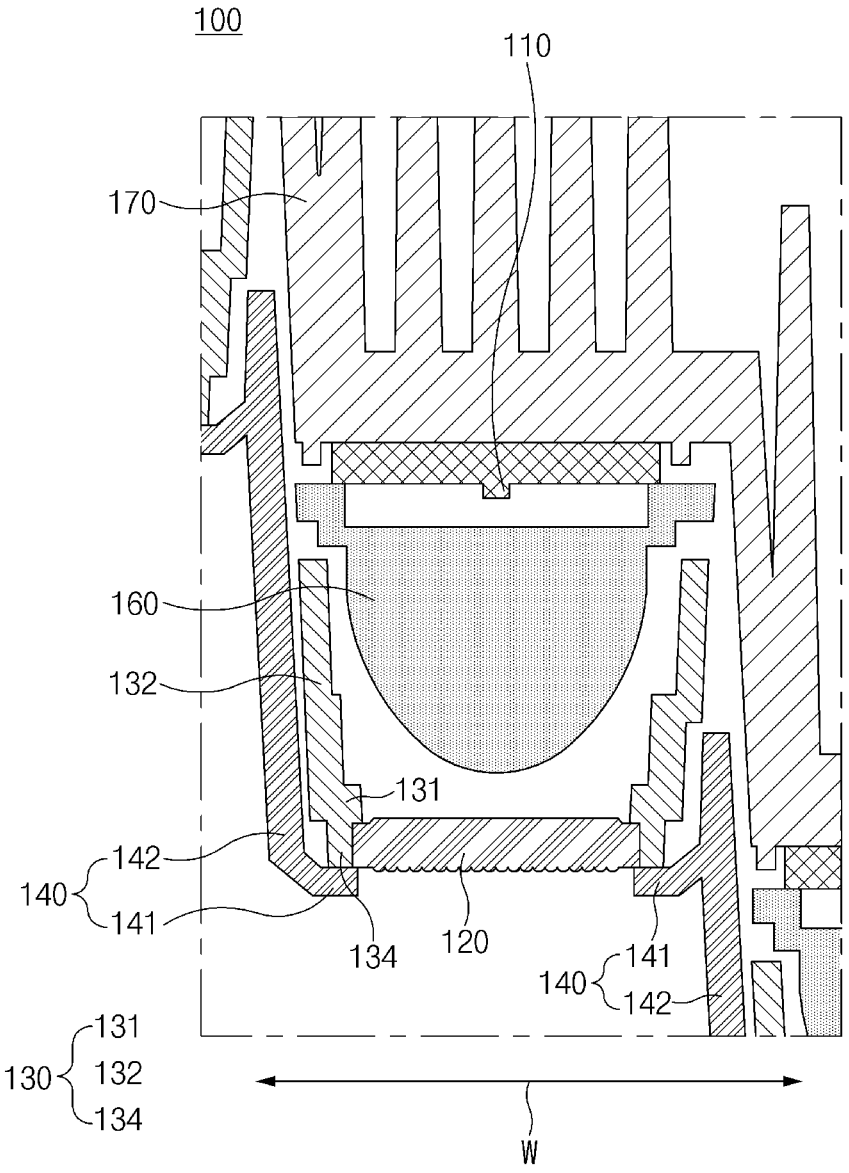
FIG. 3 is a cross-sectional view illustrating a cross-section made when one optical module provided in the lamp for a vehicle according to the embodiment of the present disclosure is cut in the horizontal direction.
Figure 4:
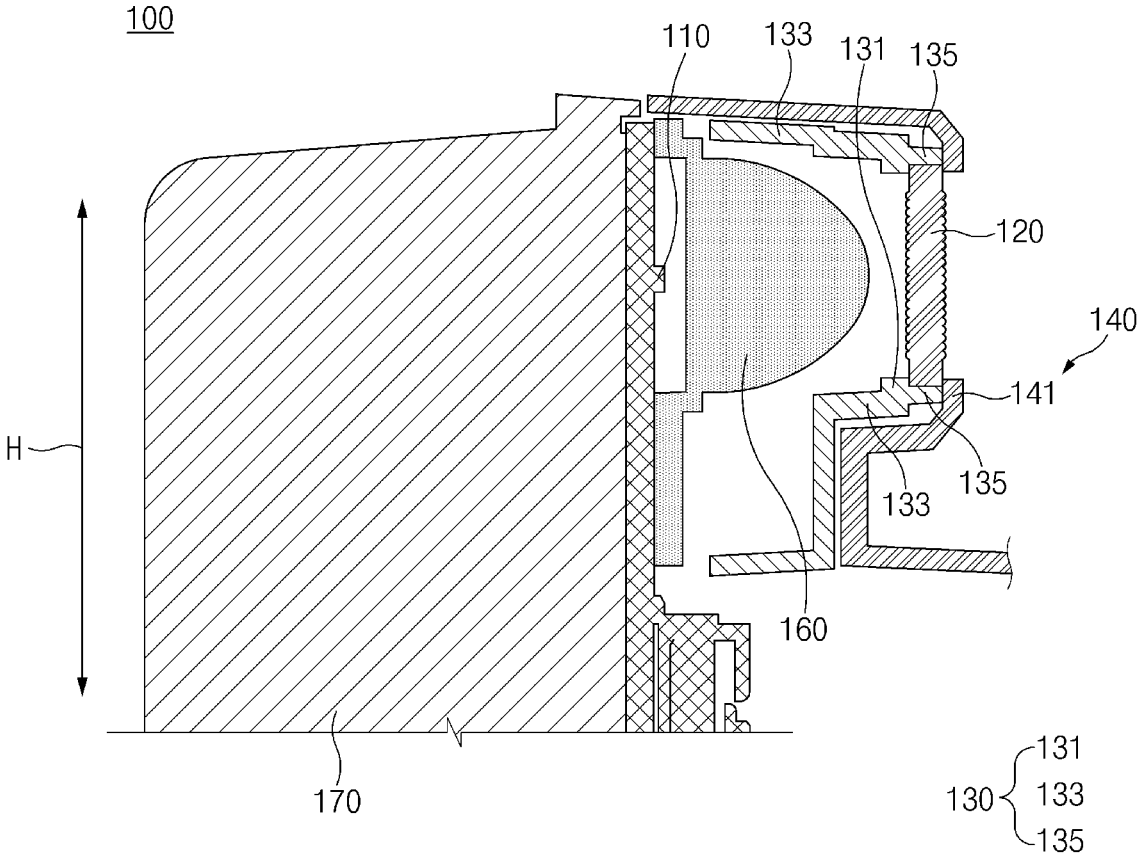
FIG. 4 is a cross-sectional view illustrating a cross-section made when one of the optical modules provided in the lamp for a vehicle according to the embodiment of the present disclosure is cut in a direction parallel to a forward/rearward direction and a vertical direction.
Figure 5:
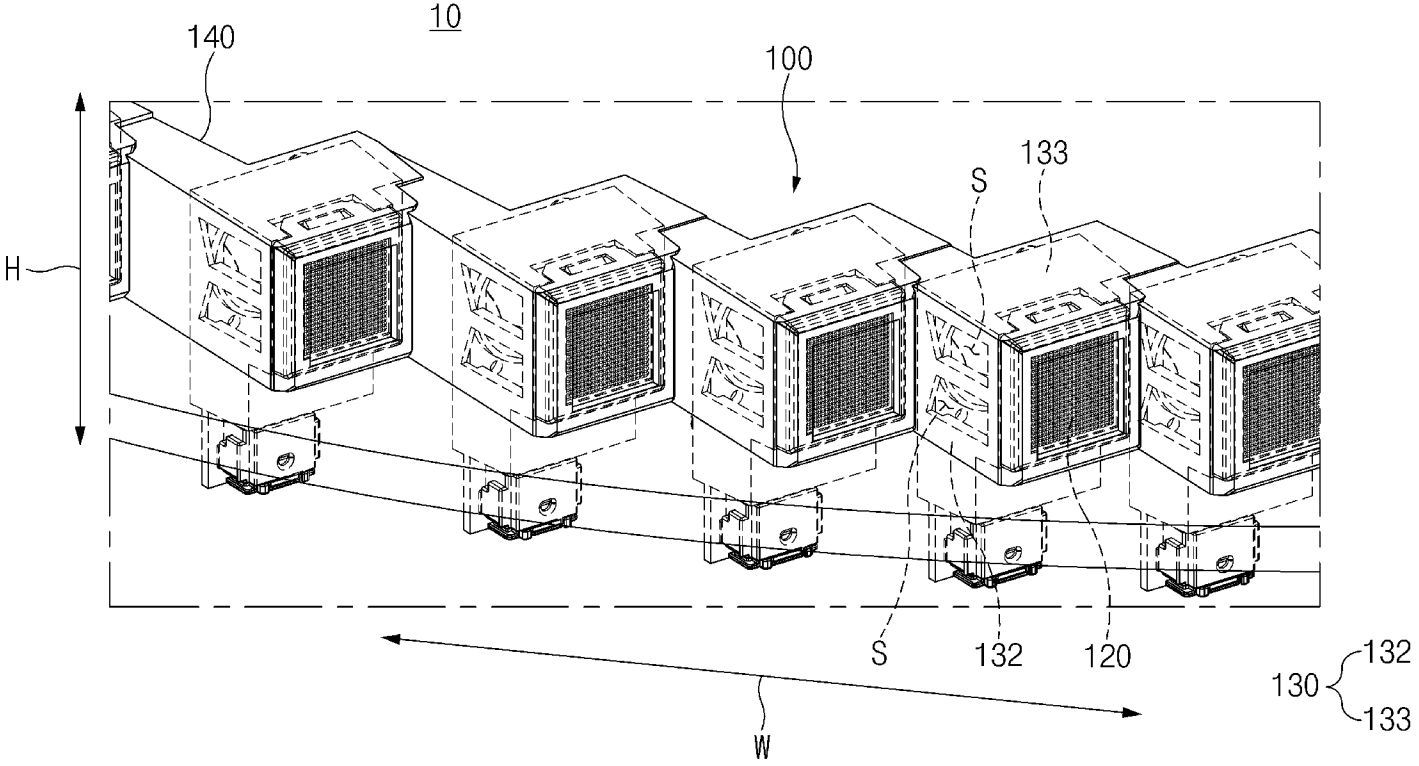
FIG. 5 is a transparent perspective view illustrating internal components surrounded by a bezel in the lamp for a vehicle according to the embodiment of the present disclosure.

FIG. 1 is a view perspective view illustrating a structure of a lamp for a vehicle according to an embodiment of the present disclosure, and FIG. 2 is a cross-sectional perspective view illustrating a structure when the lamp for a vehicle according to the embodiment of the present disclosure is cut in a horizontal direction. FIG. 3 is a cross-sectional view illustrating a cross-section made when one optical module provided in the lamp for a vehicle according to the embodiment of the present disclosure is cut in the horizontal direction, and FIG. 4 is a cross-sectional view illustrating a cross-section made when one of the optical modules provided in the lamp for a vehicle according to the embodiment of the present disclosure is cut in a direction parallel to a forward/rearward direction and a vertical direction. FIG. 5 is a transparent perspective view illustrating internal components surrounded by a bezel in the lamp for a vehicle according to the embodiment of the present disclosure.

Referring to FIGS. 1 to 5, a lamp 10 for a vehicle (hereinafter, referred to as a 'lamp') according to the present disclosure may include a plurality of optical modules 100. The plurality of optical modules 100 may each form a predetermined unit beam pattern, and the plurality of unit beam patterns may be collected to implement one beam pattern. In particular, as described below, according to the present disclosure, the plurality of unit beam patterns may be continuously connected, such that the beam pattern having a continuous shape in one direction may be implemented.

The plurality of optical modules 100 may each include: a light source 110 configured to emit light; an inner lens 120 disposed forward of the light source 110; a lens holder 130 disposed at one side of the inner lens 120 and provided to be in close contact with the inner lens 120; and a bezel 140 disposed at the other side of the inner lens 120 and provided to be in close contact with the inner lens 120. That is, according to the present disclosure, the lens holder 130 and the bezel 140 may fix the inner lens 120 by being in close contact with the inner lens 120.

In this case, as illustrated in FIG. 5, according to the present disclosure, a through-hole S may be formed in at least one lateral surface of the lens holder 130 and provide a route through which the light emitted from the light source 110 passes. In addition, the bezel 140 may include a light transmissive material. In particular, the bezel 140 may be made of a light transmissive material. In contrast, the lens holder 130 may be made of a non-transmissive material.

As illustrated in FIGS. 1 to 5, the lens holder 130 may be configured to surround not only the inner lens 120, but also the other components such as the light source 110 provided in the optical module 100. Therefore, the light beam, which reaches the lens holder 130 made of a non-transmissive material among the light beams emitted from the light source 110, cannot pass through the lens holder 130.

However, as described above, according to the present disclosure, because the through-hole S is formed in the lens holder 130, at least some of the light beams, which are emitted from the light source 110 and reach the lens holder 130, may propagate to the outside through the through-hole S. Therefore, according to the present disclosure, a relatively large unit beam pattern may be formed in one direction by the optical module 100 in comparison with a case in which no through-hole S is formed.

More specifically, as illustrated in FIG. 1, the plurality of optical modules 100 may be disposed in a leftward/rightward direction W. The lens holder 130 may include: a first holder region 131 disposed rearward of the inner lens 120 and configured to press at least a part of a rear surface of the inner lens 120; and a second holder region 132 extending rearward from one end of the first holder region 131 based on the leftward/rightward direction W. In this case, the through-hole S may be a lateral through-hole S provided in the second holder region 132. Therefore, according to the present disclosure, the beam pattern formed by each of the optical modules 100 is formed not only by the light emitted from the light source 110 and propagating to the outside through the inner lens 120, but also by the light propagating to the outside through the lateral through-hole S provided in the second holder region 132. Therefore, the two beam patterns formed by the two optical modules 100 adjacent to each other in the leftward/rightward direction W may be continuously connected. Therefore, according to the present disclosure, it is possible to implement a beam pattern that is slim in an upward/downward direction H and has continuous brightness in the leftward/rightward direction W. For example, as illustrated in FIG. 5, the lateral through-hole S may be provided in plural, and the plurality of lateral through-holes S may be provided in the second holder region 132 and spaced apart from one another in the upward/downward direction H. However, only the single lateral through-hole S may be provided in the second holder region 132. Alternatively, the plurality of lateral through-holes S may be spaced apart from one another in a forward/rearward direction.

Meanwhile, it should be interpreted that the configuration in which the plurality of optical modules 100 is disposed in the leftward/rightward direction W may include a case in which the optical modules 100 are disposed so that the distance from the rear side to the optical module increases in one direction of the leftward/rightward direction W, as illustrated in FIG. 1.

Meanwhile, similar to the lens holder 130, the bezel 140 may also be divided into a plurality of regions. For example, the bezel 140 may include: a first bezel region 141 disposed forward of the inner lens 120 and configured to press at least a part of a front surface of the inner lens 120; and a second bezel region 142 extending rearward from one end of the first bezel region 141 based on the leftward/rightward direction W. In this case, as illustrated in FIGS. 2 and 3, the first bezel region 141 may be disposed to face the first holder region 131 in the leftward/rightward direction W with the inner lens 120 interposed therebetween, and the second bezel region 142 may be disposed to face the second holder region 132 in the leftward/rightward direction W. Therefore, according to the present disclosure, the light exiting the lateral through-hole S provided in the second holder region 132 may propagate to the outside through the second bezel region 142. Meanwhile, as described above, the bezel 140 may be made of a light transmissive material, and thus the second bezel region 142 may also be made of a light transmissive material. Therefore, the light exiting the lateral through-hole S may propagate to the outside through the second bezel region 142.

Meanwhile, referring to FIG. 4, the lens holder 130 may further include a third holder region 133 extending rearward from one end of the first holder region 131 based on the upward/downward direction H. For example, as illustrated in FIG. 4, the third holder region 133 may have a shape extending rearward from two opposite ends of the first holder region 131 based on the upward/downward direction H.

In this case, according to the present disclosure, the third holder region 133 may be made of a non-transmissive material, and the third holder region 133 may have no through-hole S. Therefore, according to the present disclosure, the light emitted from the light source 110 of the optical module 100 may not propagate to the outside through the upper and lower surfaces of the lens holder 130. Therefore, according to the present disclosure, the unit beam pattern formed by the optical module 100 may be expanded in the leftward/rightward direction without being expanded in the upward/downward direction. Therefore, the beam pattern (e.g., the low beam light distribution pattern) may meet the prescribed regulations.

Meanwhile, the first bezel region 141 may be disposed to face a peripheral region of the front surface of the inner lens 120. A central region of the first bezel region 141 may be opened in the forward/rearward direction. Therefore, the first bezel region 141 may press the peripheral region of the inner lens 120.

Meanwhile, as illustrated in FIG. 2, the plurality of optical modules 100 provided in the lamp 10 according to the present disclosure may include a first optical module 100*a*, and a second optical module 100*b* disposed adjacent to one side of the first optical module 100*a* in the leftward/rightward direction W. In this case, according to the present disclosure, the first bezel region 141 of the first optical module 100*a* and the second bezel region 142 of the second optical module 100*b* may be integrated.

The above-mentioned contents may be equally applied to the two optical modules 100 disposed adjacent to each other in the leftward/rightward direction W in the lamp 10 according to the present disclosure. In this case, the plurality of bezels 140 constituting the plurality of optical modules 100 provided in the lamp 10 according to the present disclosure may be integrated. However, the bezels 140 provided in the respective optical modules 100 may be separately provided.

Referring to FIG. 3, according to the present disclosure, the lens holder 130 may include a fourth holder region 134 extending forward from one end of the first holder region 131 based on the leftward/rightward direction W and configured to surround the inner lens 120 from the outside in the leftward/rightward direction W. In this case, the fourth holder region 134 may press the inner lens 120 in the leftward/rightward direction W and be provided to be in close contact with a rear surface of the first bezel region 141. Therefore, according to the present disclosure, it is possible to more effectively prevent the separation of the inner lens 120 in the leftward/rightward direction W.

In addition, as illustrated in FIG. 4, according to the present disclosure, the lens holder 130 may further include a fifth holder region 135 extending forward from one end of the first holder region 131 based on the upward/downward direction H and configured to surround the inner lens 120 from the outside in the upward/downward direction H. In this case, the fifth holder region 135 may press the inner lens 120 in the upward/downward direction H and be provided to be in close contact with the rear surface of the first bezel region 141. Therefore, according to the present disclosure, it is possible to more effectively prevent the separation of the inner lens 120 in the upward/downward direction H. Similar to the third holder region 133, the fifth holder region 135 may also have a shape extending from the two opposite ends of the first holder region 131 based on the upward/downward direction H.

Figure 6:
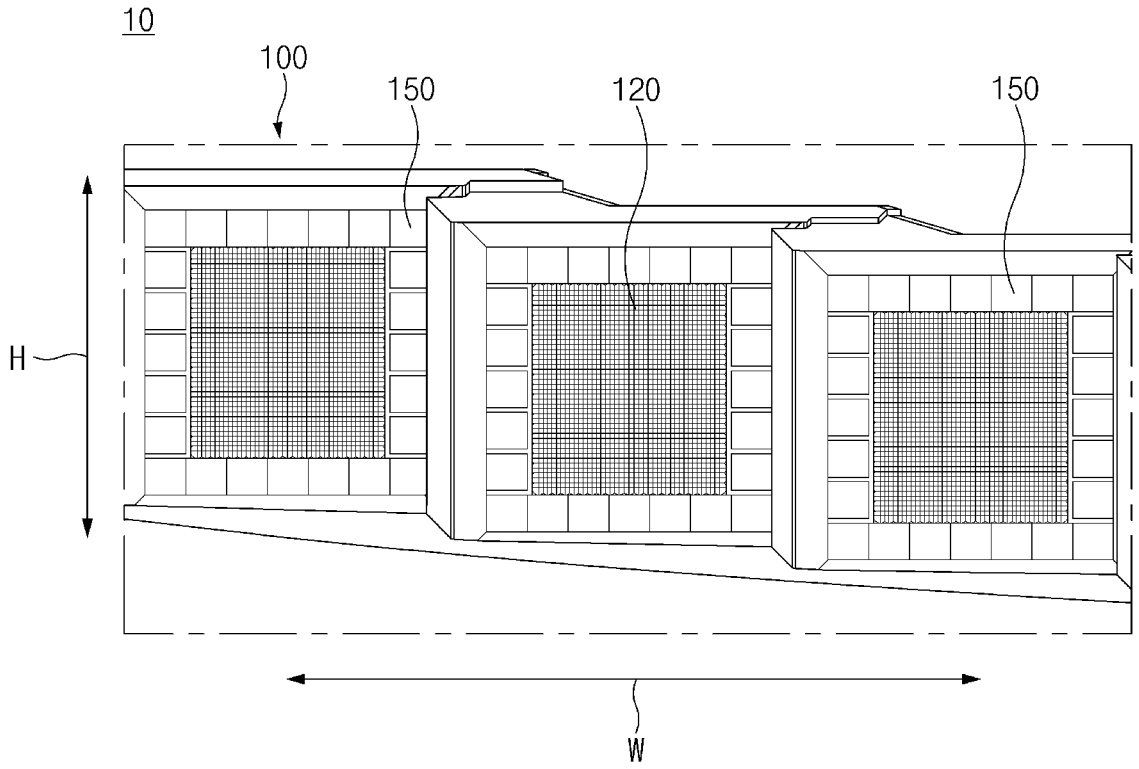
FIG. 6 is a front view illustrating a lamp for a vehicle according to another embodiment of the present disclosure when viewed from the front side.
Figure 7:
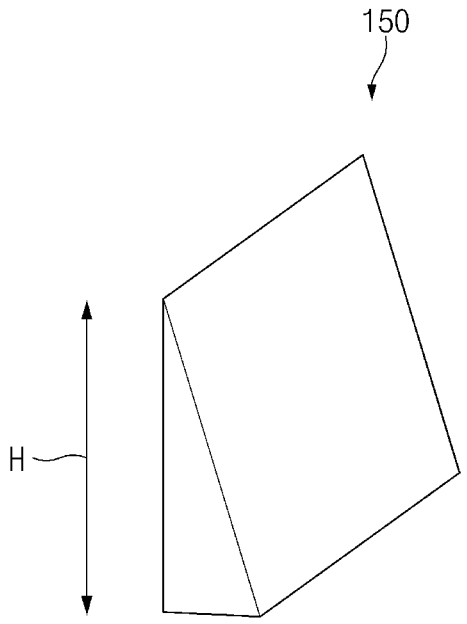
FIG. 7 is a perspective view illustrating an optic member provided in the lamp for a vehicle according to another embodiment of the present disclosure.
Figure 8:
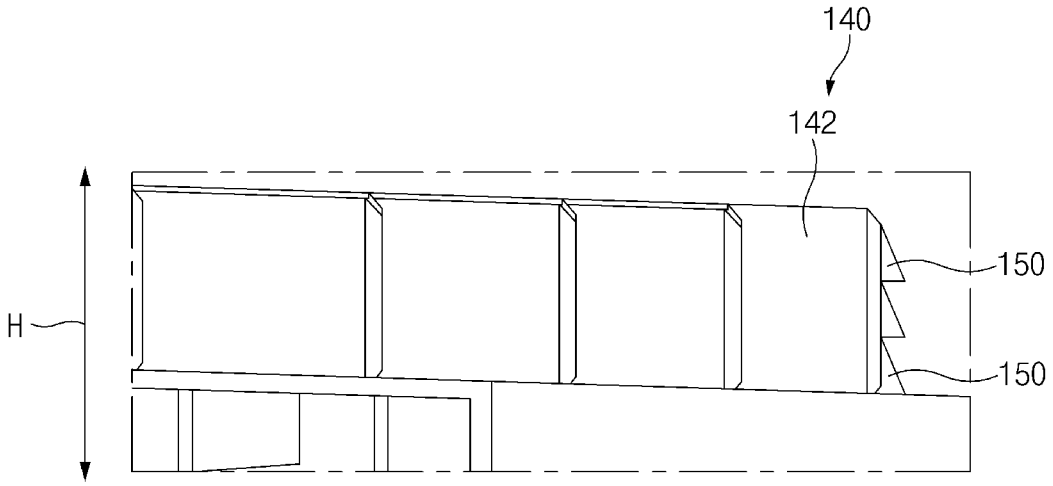
FIG. 8 is a side view illustrating the lamp for a vehicle according to another embodiment of the present disclosure when viewed from the lateral side.

FIG. 6 is a front view illustrating a lamp for a vehicle according to another embodiment of the present disclosure when viewed from the front side, and FIG. 7 is a perspective view illustrating an optic member provided in the lamp for a vehicle according to another embodiment of the present disclosure. FIG. 8 is a side view illustrating the lamp for a vehicle according to another embodiment of the present disclosure when viewed from the lateral side.

The contents described above with reference to FIGS. 1 to 5 may be equally applied to the lamp 10 according to another embodiment of the present disclosure. However, the lamp 10 according to another embodiment of the present disclosure differs from the lamp 10 according to the embodiment of the present disclosure in that an optic member 150 is additionally provided in the lamp 10.

That is, referring to FIGS. 6 to 8, the lamp 10 according to another embodiment of the present disclosure may further include the optic member 150 having light transmissivity and provided to be in close contact with the front surface of the first bezel region 141 (see FIG. 2).

The optic member 150 provided in the lamp 10 according to another embodiment of the present disclosure may be configured to refract downward the light exiting the first bezel region 141 and allow the light to propagate to the outside. Therefore, according to another embodiment of the present disclosure, the optic member 150 may more effectively form the beam pattern (e.g., the low beam light distribution pattern) that meets the prescribed regulations. Further, the optic member 150 may prevent the internal components in the optical module 100 from being visible from the outside.

To this end, the optic member 150 may have a shape having a length in the forward/rearward direction that increases in the downward direction. For example, as illustrated in FIG. 7, the optic member 150 may have a triangular prismatic shape. In addition, as illustrated in FIGS. 6 and 8, the optic member 150 may be provided in plural, and the plurality of optic members 150 may be disposed along the peripheral region of the first bezel region 141. However, the optic members 150 may be respectively disposed on left and right portions of the first bezel region 141, one for each of the left and right portions.

Figure 9:
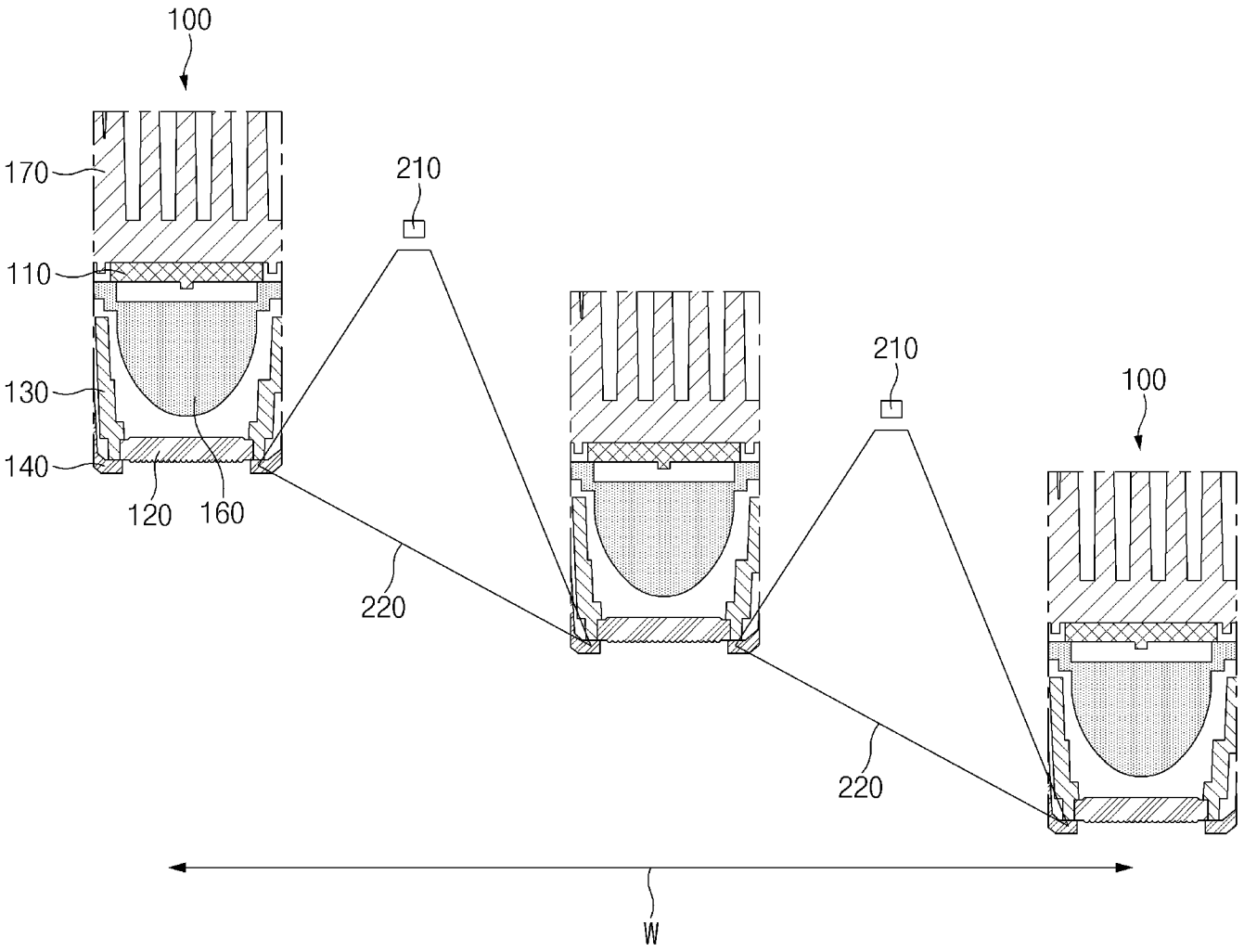
FIG. 9 is a top plan view illustrating a lamp for a vehicle according to still another embodiment of the present disclosure when viewed from above.

FIG. 9 is a top plan view illustrating a lamp for a vehicle according to still another embodiment of the present disclosure when viewed from above.

The contents described above with reference to FIGS. 1 to 8 may be equally applied to the lamp according to still another embodiment of the present disclosure. However, the present embodiment of the present disclosure differs from the above-mentioned embodiment in that additional light sources 210 and additional bezels 220 are further provided in the lamp 10.

That is, as illustrated in FIG. 9, according to still another embodiment of the present disclosure, the plurality of optical modules 100 is provided to be spaced apart from one another in the leftward/rightward direction W. The lamp may further include: the additional light source 210 provided between the two optical modules 100 adjacent to each other in the leftward/rightward direction W; and the additional bezel 220 disposed forward of the additional light source 210 and having two opposite ends disposed in the leftward/rightward direction W and provided to be in close contact with the bezels 140 respectively provided in the two optical modules 100.

The additional light source 210 and the additional bezel 220 according to still another embodiment of the present disclosure may be configured to allow the beam pattern formed by the lamp 10 according to the present disclosure to have more continuous brightness. Therefore, the components such as the inner lens may not be provided between the additional light source 210 and the additional bezel 220 because the additional beam pattern only needs to be formed by the additional light source 210 and the additional bezel 220 in the region between the two unit beam patterns respectively formed by the two adjacent optical modules 100. Furthermore, the additional bezel 220 only needs to fill the space between the two bezels 140 respectively provided in the two adjacent optical modules 100. Therefore, the bezel 140 and the additional bezel 220 may have different geometric shapes.

Meanwhile, the inner lens 120 provided in the lamp 10 according to the present disclosure may be a micro-lens array (MLA). However, the type of inner lens 120 is not limited thereto.

In addition, the lamp 10 according to the present disclosure may further include a collimator 160 disposed between the light source 110 and the inner lens 120, and a heat sink 170 provided to be in contact with a rear portion of the light source 110.

Vehicle

A vehicle according to the present disclosure may include the lamp 10 for a vehicle including the plurality of optical modules 100. The lamp 10 may be a headlamp, for example, a low beam headlamp.

The plurality of optical modules 100 may each include: the light source 110 configured to emit light; the inner lens 120 disposed forward of the light source 110; the lens holder 130 disposed at one side of the inner lens 120 and provided to be in close contact with the inner lens 120; and the bezel 140 disposed at the other side of the inner lens 120 and provided to be in close contact with the inner lens 120.

In this case, according to the present disclosure, the through-hole S may be provided in at least one lateral surface of the lens holder 130 and allow the light emitted from the light source 110 to pass through the through-hole S.

Meanwhile, the above-mentioned contents related to the lamp according to the present disclosure may be equally applied to the vehicle according to the present disclosure, and vice versa.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, the lamp comprising:

a plurality of optical modules, each module comprising:

a light source configured to emit light;

an inner lens disposed forward of the light source;

a lens holder disposed at one side of the inner lens and in contact with the inner lens; and a bezel disposed at another side of the inner lens and in contact with the inner lens, wherein a through-hole is provided in at least one lateral surface of the lens holder so that the light emitted from the light source passes through the through-hole.

2. The lamp of claim 1, wherein the bezel includes a light transmissive material.

3. The lamp of claim 1, wherein the plurality of optical modules is disposed in a leftward/rightward direction, wherein the lens holder comprises a first holder region disposed rearward of the inner lens and configured to press at least a part of a rear surface of the inner lens; and a second holder region extending rearward from one end of the first holder region based on the leftward/rightward direction, and wherein the through-hole includes a lateral through-hole provided in the second holder region.

4. The lamp of claim 3, wherein the bezel comprises:

a first bezel region disposed forward of the inner lens and configured to press at least a part of a front surface of the inner lens; and a second bezel region extending rearward from one end of the first bezel region based on the leftward/rightward direction, wherein the second bezel region faces the second holder region in the leftward/rightward direction.

5. The lamp of claim 4, wherein the lens holder further comprises a third holder region extending rearward from one end of the first holder region based on an upward/downward direction, and the third holder region is made of a non-transmissive material.

6. The lamp of claim 4, wherein the first bezel region is disposed to face a peripheral region of the front surface of the inner lens, and a central region of the first bezel region is open in a forward/rearward direction.

7. The lamp of claim 4, wherein the plurality of optical modules comprises:

a first optical module; and a second optical module disposed adjacent one side of the first optical module in the leftward/rightward direction, and wherein the first bezel region of the first optical module and the second bezel region of the second optical module are integrated.

8. The lamp of claim 5, wherein the lens holder further comprises a fourth holder region extending forward from one end of the first holder region based on the leftward/rightward direction and configured to surround the inner lens from outside in the leftward/rightward direction.

9. The lamp of claim 8, wherein the fourth holder region is in contact with a rear surface of the first bezel region.

10. The lamp of claim 8, wherein the lens holder further comprises a fifth holder region extending forward from one end of the first holder region based on the upward/downward direction and configured to surround the inner lens from outside in the upward/downward direction.

11. The lamp of claim 10, wherein the fifth holder region is in contact with a rear surface of the first bezel region.

12. The lamp of claim 3, wherein the lateral through-hole comprises a plurality of through-holes, and the plurality of lateral through-holes is provided in the second holder region and spaced apart from one another in an upward/downward direction.

13. The lamp of claim 4, further comprising:

an optic member having light transmissivity and in contact with a front surface of the first bezel region, wherein the optic member has a shape having a length in a forward/rearward direction that increases in a downward direction.

14. The lamp of claim 13, wherein the optic member has a triangular prismatic shape.

15. The lamp of claim 13, wherein the optic member comprises a plurality of optic members, and the plurality of optic members is disposed along a peripheral region of the first bezel region.

16. The lamp of claim 1, wherein the inner lens is a micro-lens array (MLA).

17. The lamp of claim 1, further comprising:

a collimator disposed between the light source and the inner lens; and a heat sink in contact with a rear portion of the light source.

18. The lamp of claim 1, wherein the plurality of optical modules is spaced apart from one another in a leftward/rightward direction, and wherein the lamp further comprises:

an additional light source disposed between the two optical modules adjacent each other in the leftward/rightward direction; and an additional bezel disposed forward of the additional light source and having two opposite ends disposed in the leftward/rightward direction and in contact with the bezels respectively provided in the two optical modules.

19. The lamp of claim 18, wherein the bezel and the additional bezel have different geometric shapes.

20. A vehicle comprising:

a lamp comprising a plurality of optical modules, each optical module comprising:

a light source configured to emit light;

an inner lens disposed forward of the light source;

a lens holder disposed at one side of the inner lens and in contact with the inner lens; and a bezel disposed at another side of the inner lens and in contact with the inner lens, wherein a through-hole is provided in at least one lateral surface of the lens holder so that the light emitted from the light source passes through the through-hole.

* * * * *